US007598445B1

(12) United States Patent
Johnston

(10) Patent No.: US 7,598,445 B1
(45) Date of Patent: Oct. 6, 2009

(54) DETONATOR WITH CUSHIONED MALLET

(76) Inventor: Darrell N. Johnston, 1065 Lomita Blvd., Space 220, Harbor City, CA (US) 90710

( * ) Notice: Subject to any disclaimer, the term of this patent is extended or adjusted under 35 U.S.C. 154(b) by 0 days.

(21) Appl. No.: 12/210,810

(22) Filed: Sep. 15, 2008

(51) Int. Cl.
*G10D 13/02* (2006.01)

(52) U.S. Cl. ..... 84/422.1; 84/422.3; 84/411 R; 84/421

(58) Field of Classification Search ..... 84/422.1, 84/411 R, 411 P, 422.3, 421
See application file for complete search history.

(56) References Cited

U.S. PATENT DOCUMENTS

| | | | | | |
|---|---|---|---|---|---|
| 1,808,085 | A | * | 6/1931 | Troppe | 84/422.1 |
| 2,722,860 | A | * | 11/1955 | Pace | 84/411 R |
| 2,784,635 | A | * | 3/1957 | Troppe | 84/422.1 |
| 2,822,717 | A | * | 2/1958 | Slawienski | 84/422.1 |
| 3,008,367 | A | | 11/1961 | Parsons | |
| 3,750,517 | A | | 8/1973 | Sleishman | |
| 3,797,356 | A | | 3/1974 | Duffy et al. | |
| 3,967,523 | A | | 7/1976 | Currier et al. | |
| 4,028,984 | A | | 6/1977 | Sanchez | |
| 4,149,444 | A | | 4/1979 | Parsons | |
| 4,200,025 | A | * | 4/1980 | Currier | 84/422.1 |
| 4,538,499 | A | | 9/1985 | Livingston | |
| 4,744,279 | A | | 5/1988 | Livingston | |
| 4,817,485 | A | * | 4/1989 | Bozzio et al. | 84/746 |
| 4,841,830 | A | | 6/1989 | Yamashita | |
| 5,301,592 | A | * | 4/1994 | Johnston | 84/422.1 |
| 6,201,173 | B1 | * | 3/2001 | Black | 84/422.1 |
| 6,683,240 | B1 | * | 1/2004 | Cubranich | 84/465 |
| 6,979,770 | B2 | * | 12/2005 | Hampton, Jr. | 84/723 |
| 7,074,997 | B2 | * | 7/2006 | Steele | 84/422.1 |
| 7,339,103 | B2 | * | 3/2008 | Hilburn | 84/422.1 |
| 7,435,888 | B2 | * | 10/2008 | Steele | 84/422.1 |
| 7,470,847 | B2 | * | 12/2008 | Kitagawa | 84/422.1 |
| 7,531,733 | B2 | * | 5/2009 | Steele | 84/422.1 |
| 2004/0025667 | A1 | * | 2/2004 | Hampton, Jr. | 84/426 |
| 2005/0211058 | A1 | | 9/2005 | Crane | |

* cited by examiner

*Primary Examiner*—Jeffrey Donels
*Assistant Examiner*—Robert W Horn
(74) *Attorney, Agent, or Firm*—Fulwider Patton LLP

(57) ABSTRACT

A cantilever spring carrying a mallet with a low friction tip.

16 Claims, 2 Drawing Sheets

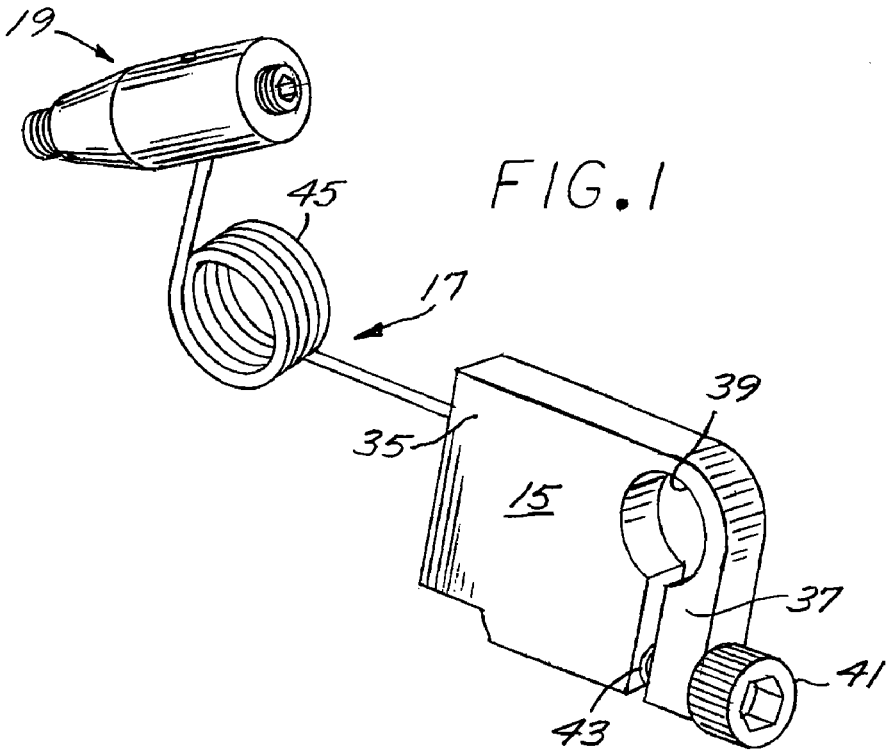
FIG. 1
FIG. 2
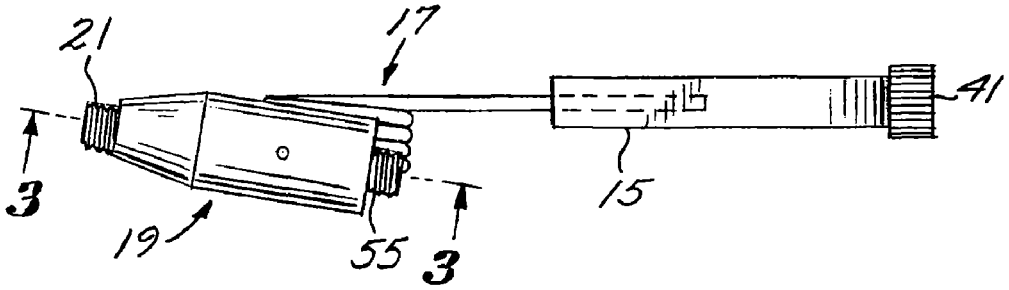
FIG. 3
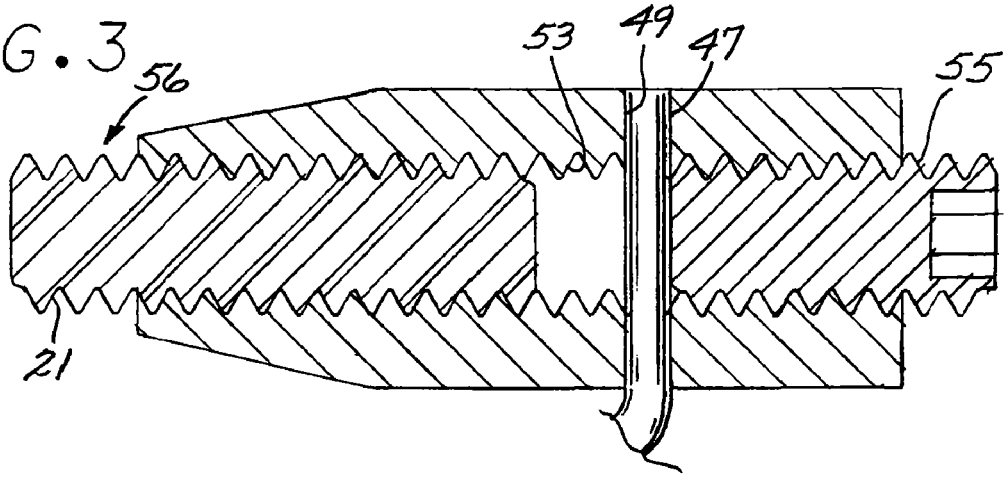

DETONATOR WITH CUSHIONED MALLET

BACKGROUND

1. Field of the Invention

The present invention relates to percussion instrument hardware.

2. Description of Prior Art

Percussion instruments have long been used in the musical field such as orchestral music, concert, band music and marching music and typically includes a drum, drum set or bass drum. The bass drum is used to mark time and project tempo. The drum can be utilized to provide a basic beat and its use can vary from being merely a basic time keeping medium to being a melodic voice in conjunction with other parts of the symbol set. In classical music, the bass drum often punctuates a musical impact.

A bass drum is played using a pedal-operated mallet or beater operated by the drummer's foot. It is believed that William F. Ludwig made the first bass drum pedal workable in about 1909, paving the way for the modern drum kit. A bass drum pedal operates much the same as a hi-hat where a foot plate is depressed to bring a "beater" or mallet into the drum membrane. A spring tension typically controls the amount of pressure needed to strike and the amount of recoil upon release.

A drummer is involved in many different techniques for carrying out his or her contribution which may involve numerous different actuations of the pedal to generate the desired acoustics. Examples of acoustic drum pedals appear in U.S. Pat. No. 3,797,356 to Duffy, U.S. Pat. No. 3,967,523 to Currier and in U.S. Pat. No. 4,538,499 to Livingston.

Drum pedal devices have been proposed which control synthesizers to produce synthesized percussive sounds. Over the years electronic percussion instruments such as drum synthesizers and electronic drums, which convert acoustic sounds or vibrations into synthesized percussive sounds, have proliferated in the field of music. Pedals have been proposed to control production of synthesized percussive sounds. One such device is incorporated in a conventional pedal and, includes a sounding block or trigger mounting on a vibration pick up. When the beater strikes the trigger, the pick up generates an electrical signal which is transferred to synthesizer to produce the synthesized percussive sound. A device of this type is shown in U.S. Pat. No. 4,200,025 to Currier.

Problems have been encountered with a shock resulting from the impact with the synthesizer trigger and from reverberation which may affect the quality of the percussive sound. In addressing this issue, a pedal has been proposed which includes a hinged plate with an elevated end mounting on the underside thereof in cantilever fashion a leaf spring which carries on the free extremity thereof an actuator button intended to, upon depression of the free extremity of the pedal, contact an electrical transducer for generating an electrical signal which may be processed to produce the desired musical tone. A device of this type is shown in U.S. Pat. No. 4,744,279 to Livingston. Devices of this type, while effective to produce the particular results, are relatively expensive to manufacture and can tend to, with repeated action, wear the face of the transducer.

One highly successful bass drum pedal device includes a pedal hinged on one end to a bass and having its free extremity biased upwardly and connected through a series of levers to a drum beater to drive the beater against the drum membrane upon depression of the pedal itself. This pedal device, sold by the assignee of the present application under the designation Electronic Upgrade Kit, includes a design of the general type is shown my U.S. Pat. No. 5,301,592. The pedal device includes a striker carried telescopically on a striker body and biased downwardly toward a transducer by means of a coil spring but elevatable away from the transducer by means of a spring biased arm such that, when the pedal is depressed the striker will be lowered to drive the plunger against the surface of the transducer to actuate such transducer. While this device has enjoyed great commercial success, it suffers the shortcoming that the striker tends to wear out the contact surface on the transducer thus shortening the service life and detrimentally effecting the musical tones, sometimes further adulterated by excessive rebound of the striker from the transducer.

SUMMARY OF THE INVENTION

The drum actuator of the present invention includes a striker configured with a mallet having a cushioned striking end and carried cantileverly from a actuating pivot by means of a spring such that actuation of the actuator will drive the cushion service of mallet resiliently into contact with the transducer surface.

BRIEF DESCRIPTION OF THE DRAWINGS

FIG. 1 is a perspective view of mallet and lever arm incorporated in a preferred embodiment of the bass drum pedal actuating apparatus of the present invention;

FIG. 2 is a top plan view thereof;

FIG. 3 is a longitudinal section view, in enlarged scale, taken through the lines 3-3 of FIG. 2;

DETAILED DESCRIPTION OF THE PREFERRED EMBODIMENTS

Figure 4:
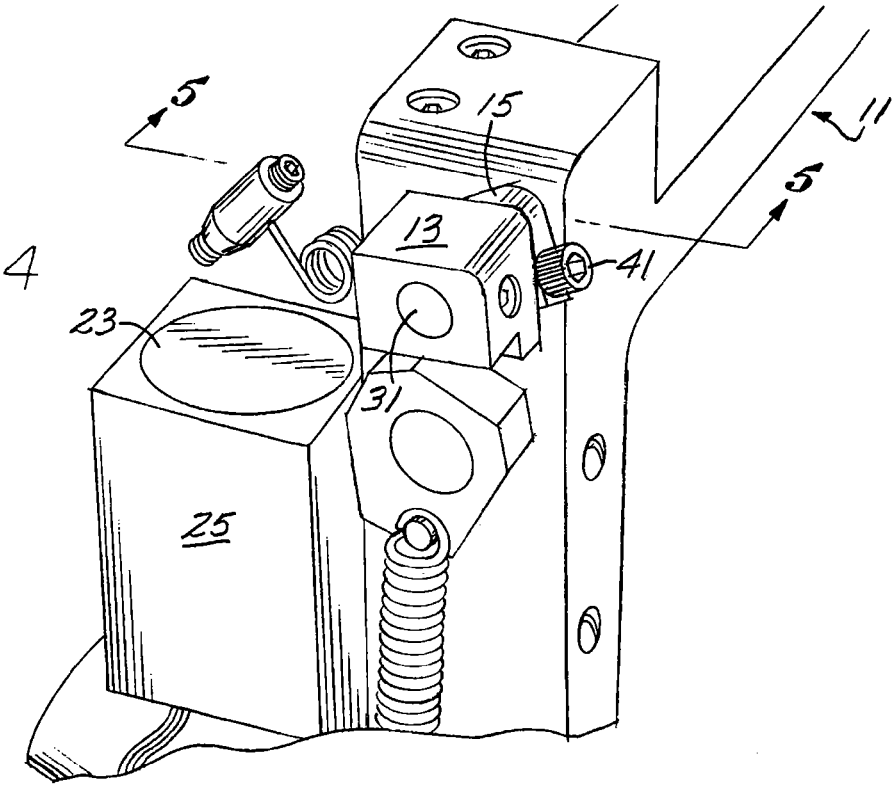
FIG. 4 is a perspective view, in reduced scale, of a bass drum pedal actuating apparatus embodying the present invention and including the hammer shown in FIG. 1.
Figure 5:
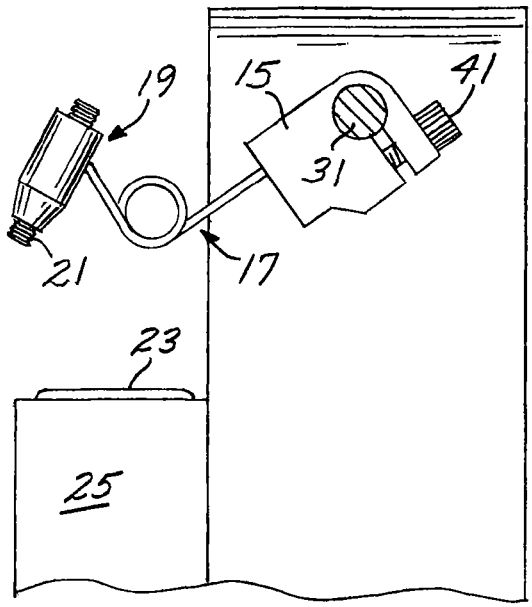
FIG. 5 is a side view of the bass drum pedal actuating apparatus of FIG. 4
Figure 6:
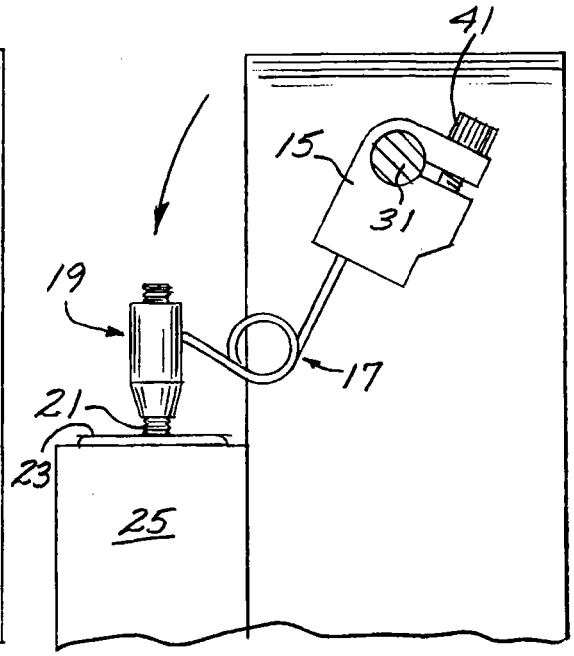
FIG. 6 is a side view similar to FIG. 5 with the hammer actuated.

Referring to FIGS. 1, 4 and 6, the bass drum actuating apparatus of the present includes, generally, a foot pedal apparatus mounted on a frame 11 and operable to rotate a rocker shaft 31 to orbit a cantilevered spring arm 17 counterclockwise downwardly as viewed in FIGS. 4 and 6 to drive a mallet 19 downwardly to engage its low friction tip 21 with the working surface 23 of a transducer mounted on a trigger box 25.

Electrical musical instruments are popular with modern musical groups. Percussion instruments are an important part of the musical array and typically incorporate a mechanical vibration in a transducer to convert a mechanical vibration to an electrical signal which is then employed to produce an electrical signal which functions to produce a musical tone to compliment the other instruments in the band.

Drum pedal devices typically incorporate a frame mounting an elongated pedal hingedly connected on one end with the opposite end being biased to an elevated positions and configured such that when the drummer presses downwardly on the free extremity of the pedal a mallet is impact with the planar working surface of a transducer to generate the desired working electrical signal. It has been a problem with the prior art that such mallets are typically of metallic construction and upon repeated contact of the mallet driven through an arcuate path where the working surfaces of the transducer in a relatively unyielding manner, typically creating high translational friction between the mallet and working surface such that the slight slippage upon frictional contact of the mallet over an extended period of time, produces wear on the working surface to the point where the transducer itself must be replaced. It is this problem to which the present invention is directed.

The drum actuating apparatus of the present invention may be employed in any conventional drum pedal apparatus and is particularly adapted to be incorporated in the foot pedal apparatus shown in my U.S. Pat. No. 5,301,592 which is incorporated herein by reference.

Drum actuating devices typically incorporate a hinged pedal mounted from a frame 11 such that when the pedal is depressed, a shaft 31 (FIG. 4) is rotated counterclockwise to rotate rocker 13. The actuator of the present invention takes advantage of this characteristic to accomplish the desired results. Mounted from the frame 11 adjacent the rocker shaft 31 is the trigger box 25 which mounts a transducer having an upwardly facing working surface 23.

A mounting fitting 15 in the form of a C-shaped clamp configured with a body 35 which is forked to provide a resilient actuating arm 37 cooperating to form a proximal main central bore 39 and receiving a thumb screw 41 slip fit through an orthogonal bore formed distally therein. The tip of the shank of the thumb screw 41 is screwably received into a threaded bore 43 configured in the body 35 such that by tightening the screw 41 the arm 37 is flexed to draw the free end toward the body to reduce the cross section of the main bore 39 thereby clamping down on the shaft.

Thus, the thumb screw 41 may easily be loosened to free the fitting 15 to be clocked about the shaft 31 to a degree necessary to adjust the timing for impact of the low friction tip 21 with the transducer surface 23 to coordinate impact with the timing for which acoustics emanate from the bass drum being struck by the primary beater and to also allow adjustment to compensate for electronic delays in complex synthesized sounds provide for simultaneous elimination of the sound.

The spring arm 17 is in the form of a torsion spring configured centrally with a coil 45 disposed with its axis perpendicular to the longitudinal axis of the arm itself. The proximal end of the arm 17 is press fit into a transverse bore formed in the body 35 and is formed on its free end with a stem 37 slip fit through a diametrical bore 49 formed in the body of the mallet 19.

Referring to FIG. 3, the mallet 19 is in a form of a brass barrel, conically shaped at its working end and defining a longitudinal, through bore 53 formed with internal threads and receiving in its back end a set screw 55. Screwed into the working end of the mallet 19 is an externally threaded nylon plug 56 defining at its exposed end the low coefficient of friction tip 21. It will be appreciated that the plug 56 may be constructed of numerous different materials, it only being important that it be somewhat soft and of a low coefficient of friction to thus enhance the freedom of movement between the axial end thereof and the working surface 23.

In operation, it will be noted that the actuator of the present invention may be conveniently retrofitted onto a conventional drum pedal apparatus. The rocker 13 may be conveniently removed from the rotary shaft 31 and the mounting bracket 15 fitted thereover and the thumb screw 41 tightened to hold it in position. The actuator may conveniently be mounted and arranged such that when the pedal (not shown) is depressed, the hammer will be rotated counterclockwise downwardly into position shown in FIG. 6 causing the distal tip 21 to engage the working surface 23 in a perpendicular direction along the line of the tangent to the path of travel to thereby achieve the major impact for actuating the transducer while minimizing relative lateral movement of the tip plug 21. It will be appreciated that in this arrangement the coils of the torsion spring 45 are disposed in a vertical plane with the axis of such spring projecting generally parallel to the working surface 23 so that the torsion spring provides a yielding force on the hammer and consequently the tip 21 thereby providing positive orientation of such hammer while tending to absorb vibration from the impact, reduce rebound of the mallet and tending to allow for a certain amount of lost motion between the rotary shaft 31 and the transducer surface 23 thereby minimizing the tendency of the hammer to be driven into the working surface 23 and avoiding shifting of the tip 21 across the surface which might otherwise add to frictional wear of such surface.

The foregoing will be appreciated that the bass drum actuating apparatus of the present invention provides an economical and convenient means for actuating the transducer in a reliable and effective manner without undue wear and deterioration of the working surface of the transducer.

I claim:

1. A bass drum actuator apparatus comprising:

a foot pedal device including a stanchion, a shaft journal across the top of the stanchion, and a rotary shaft rotatable within the journal from a first to a striking position;

a compact trigger box mounted to the stanchion adjacent the shaft and including a transducer interacting with a vertically facing impact surface;

a mounting bracket clamped to the rotary shaft for rotating from a retracted position to an impact position when the shaft is rotated from the first to the striking position;

a compact spring wire lever arm projecting cantileverly from the bracket end and terminating in a free end, the lever arm comprising two or more coils medially along the arm and the free end displaced angularly at 90 degrees or more with respect to the bracket;

a mallet carried on the angularly displaced free end and including a low friction tip constructed to, when the shaft is in the striking position, hit the impact surface.

2. The bass drum actuator apparatus of claim 1 wherein:

the tip is plastic.

3. The bass drum apparatus of claim 1 wherein:

the spring lever arm is formed with five or more coils medially between the bracket end and the free end.

4. The bass drum actuator apparatus of claim 1 wherein:

the lever coil springs are configured and arranged to flex, as the tip strikes the impact surface, and to hold the mallet generally perpendicular to the impact surface.

5. The bass drum actuator apparatus of claim 1 wherein:

the mallet is constructed with a barrel body formed with an internally threaded longitudinal bore and includes an externally threaded plastic plug screwed into the internally threaded bore and projecting therefrom to form the low friction tip.

6. The bass drum actuator apparatus of claim 1 wherein:

the mallet is constructed of an elongated brass barrel formed with a through internally threaded bore and also formed with a diametrically extending mounting bore, the hammer further including a low friction externally threaded plug received in one end of the threaded bore and constructed so the distal end thereof forms the low friction tip, the mallet even further including an externally threaded plug received in the end of the threaded bore opposite the one end; and the lever arm is formed with a shank friction fit in the mounting bore.

7. The bass drum actuator apparatus of claim 1 wherein:
the mallet is constructed of brass.

8. The bass drum actuator apparatus of claim 1 wherein:
the spring lever arm is constructed and arranged to flex, as the mallet strikes the working surface, to minimize rebound of the mallet.

9. A bass drum pedal apparatus comprising:
a pedal device including a stanchion, a shaft journal across the top of the stanchion, and a rotary shaft rotatable within the journal from a first to a striking position;
a compact trigger box mounted to the stanchion adjacent the rotary shaft and including a transducer interacting with a vertically facing impact surface;
a mallet shiftable from a retracted to a striking position, comprising a hammer portion and a lever arm portion;
a low friction beater on one end of the hammer constructed to, when the mallet is in the striking position, engage the impact surface; and
a linkage carrying the hammer comprising a helical torsion spring, a shaft engagement end and a free end operable to, upon the shaft rotating to the striking position, shift the mallet from the retracted to the striking position to yieldingly engage the impact surface with the low friction beater.

10. The apparatus of claim 9 wherein: the linkage includes a torsion spring with two or more loops.

11. The apparatus of claim 1 wherein:
the low friction means includes a plastic tip.

12. A bass drum pedal apparatus of claim 9 wherein:
the linkage is constructed to, as the mallet is shifted from the retracted to the striking position, drive its mallet through a predetermined plane and the linkage includes a spring lever arm constructed to pass through the predetermined path, the hammer being lifted from the retracted to the striking position and further includes a coil spring formed medially in the lever arm and disposed in the plane.

13. The bass drum pedal apparatus of claim 9 wherein:
the linkage is constructed to, when the low friction beater engages the working surface, direct said low friction beater through a path perpendicular to the working surface.

14. The bass drum pedal apparatus of claim 9 wherein:
the hammer is constructed with an elongated barrel formed with an internally threaded bore and includes a low friction plug received in one end thereof and projecting therefrom to form low friction means.

15. A bass drum actuator apparatus comprising:
a foot pedal device including a rotary shaft rotatable from a first to a striking position;
a trigger box mounted to the foot pedal device adjacent the shaft and including a transducer with a working surface;
a C-shaped mounting bracket constructed with a main body and a cantileverly mounted, resilient clamping arm originating at one side of a through hole clamping bore and terminating in a free extremity, the body being formed with a threaded bore aligned with the free extremity and the free extremity being formed with a through hole clamping bore aligned with the threaded bore;
a thumb screw received in the through hole clamping bore and having a shank screwed into the threaded bore;
a torsion spring lever arm affixed on one end to the main body formed with a medial a coil spring and a free end projecting distally therefrom to terminate in a shank;
a metallic mallet including a barrel formed with an axial through hole threaded mallet bore and a diametrically projecting fastener bore;
an externally threaded, elongated nylon plug received in one extremity of the through threaded mallet bore and projecting therefrom to form a low friction tip configured and arranged to, when the shaft is rotated to the striking position, engage the working surface of the transducer, and an externally threaded set screw received threadably in the end of the mallet opposite the one end and engaging the shank to secure the mallet to the spring lever arm.

16. The bass drum actuator apparatus of claim 15 wherein:
the barrel body is constructed of brass.

* * * * *